US005278544A

United States Patent [19]

Leroux

[11] Patent Number: 5,278,544

[45] Date of Patent: Jan. 11, 1994

[54] BISTABLE ELECTROOPTICAL DEVICE, SCREEN INCORPORATING SUCH A DEVICE AND PROCESS FOR PRODUCING SAID SCREEN

[75] Inventor: Thierry Leroux, Fontaine, France

[73] Assignee: Commissariat A L'Energie Atomique, France

[21] Appl. No.: 779,943

[22] Filed: Oct. 21, 1991

[30] Foreign Application Priority Data

Nov. 8, 1990 [FR] France ..... 90 13871

[51] Int. Cl.[5] ..... G09G 3/30

[52] U.S. Cl. ..... 345/74; 313/495; 315/169.3

[58] Field of Search ..... 340/781, 783; 313/495, 313/496, 422; 315/167, 169.1, 169.3

[56] References Cited

U.S. PATENT DOCUMENTS

| | | | |
|---|---|---|---|
| 4,140,941 | 2/1979 | Uemura | 313/495 |
| 4,737,781 | 4/1988 | Robillard | 340/763 |
| 4,801,850 | 1/1989 | Kagan | 315/169.3 |
| 4,908,539 | 3/1990 | Meyer | 319/169.3 |
| 4,924,148 | 5/1990 | Schwartz | 313/495 |
| 5,194,780 | 3/1993 | Meyer | 315/169.3 |

*Primary Examiner*—Ulysses Weldon
*Assistant Examiner*—Regina Liang
*Attorney, Agent, or Firm*—Hayes, Soloway, Hennessey & Hage

[57] ABSTRACT

A bistable electrooptical device, screen incorporating such a device and process for producing the screen, are provided. The device according to the present invention comprises at least one bistable element contained in a vacuum enclosure formed from a first and a second substrate, which substrates are hermetically sealed together. The bistable element comprises, on the first substrate, a first layer of a conductive material, a layer of photoconductive material, a layer of a cathodoluminiscent material, and a microtip emissive cathode electrode source, or the like, for exciting the cathodoluminiscent material. A screen according to the invention incorporates several bistable elements arranged in matrix-like configuration. In a preferred embodiment of the screen, the photoconductive material links two conductive material layers, one making up a conductive column of the screen and the other defining the geometry of the pixel. The present invention finds particular utility in the field of electrooptical memories and to high definition display fabrication.

14 Claims, 4 Drawing Sheets

FIG. 1
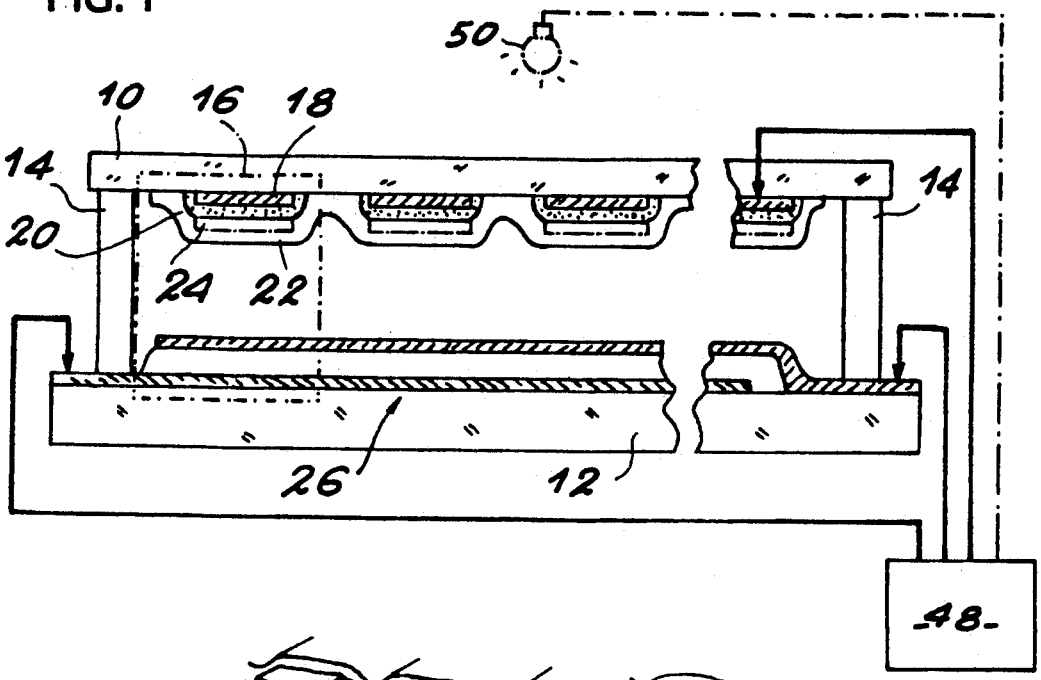
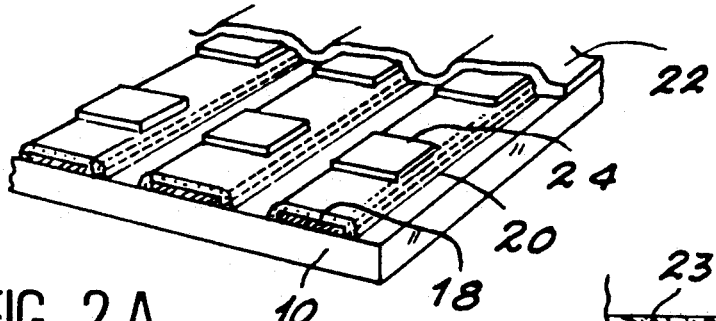
FIG. 2A
FIG. 2B
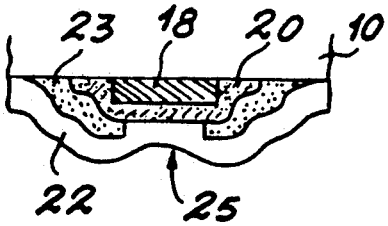
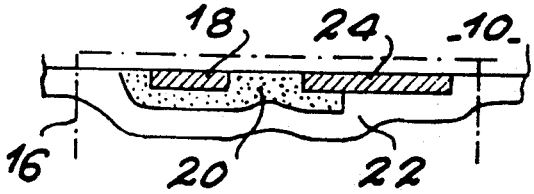
FIG. 3
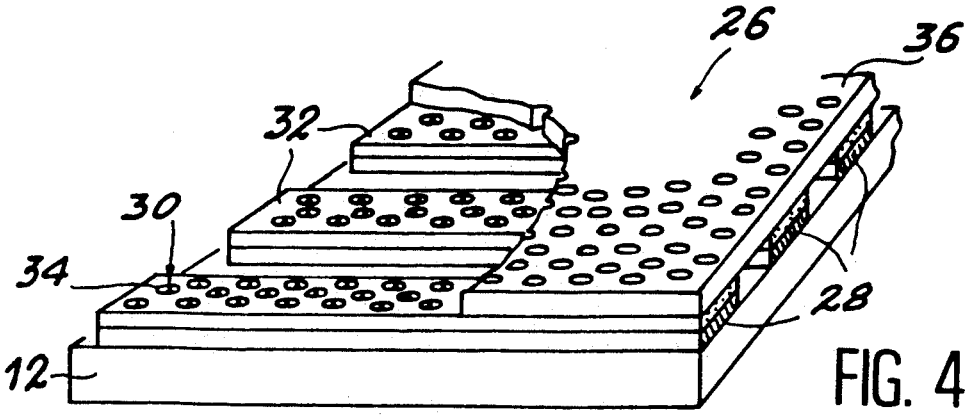
FIG. 4

FIG. 5
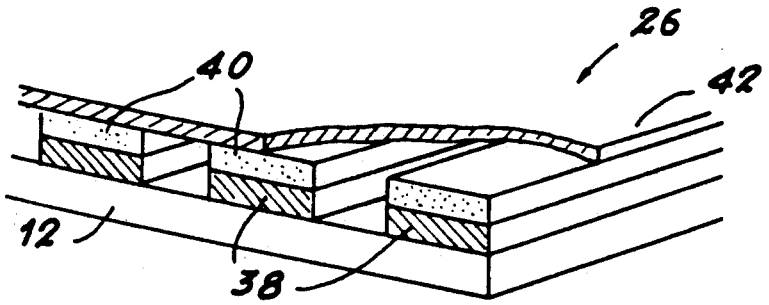
FIG. 6
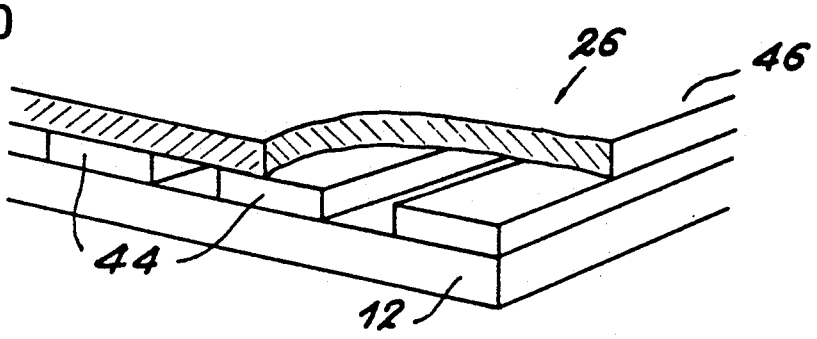
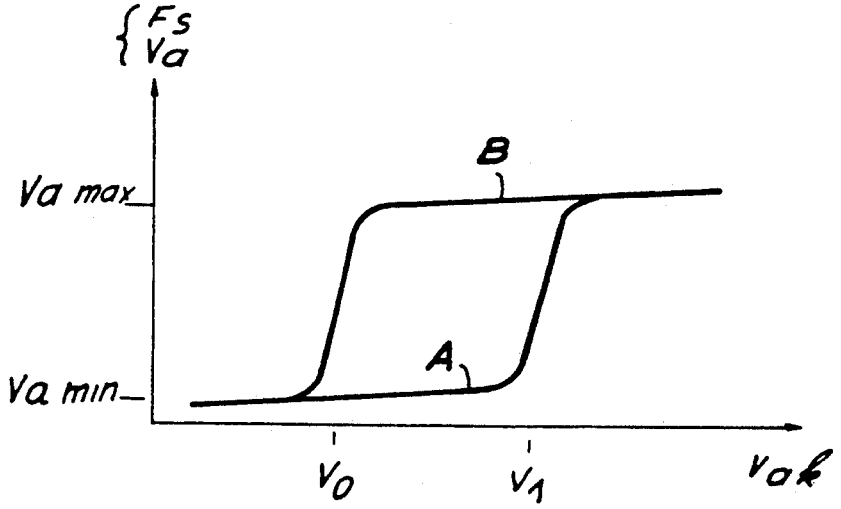
FIG. 7
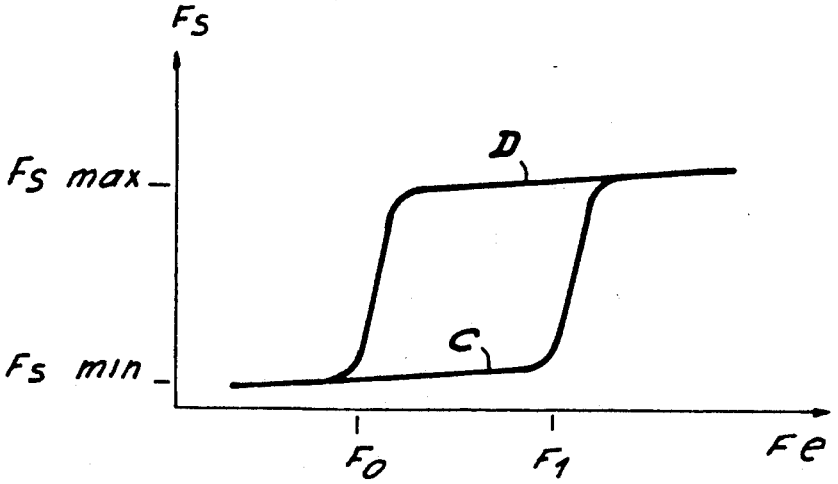
FIG. 8

BISTABLE ELECTROOPTICAL DEVICE, SCREEN INCORPORATING SUCH A DEVICE AND PROCESS FOR PRODUCING SAID SCREEN

FIELD OF THE INVENTION

The present invention relates to a bistable electrooptical device, a screen incorporating such a device and a process for producing said screen. It more particularly applies to display and visualization, but also to optical logic systems such as optical computers.

DESCRIPTION OF THE PRIOR ART

Bistable electrooptical devices are known and are described in "Electrooptic Applications of Ferroelectric Liquid Crystals to Optical Computing" by M. A. Handschy et al, published in the journal Ferroelectrics 1988, vol. 85, pp. 279–289 by Gordon and Breach Science Publishers S.A. They comprise a liquid crystal cell joined to a layer of a photoconductive material, the assembly being controlled by an external light flux. The liquid crystal cell can be transparent or opaque and may or may not transmit the control light beam.

When the light beam is transmitted, the resistivity of the photoconductive material is reduced, whereas when the transmission is substantially zero, the resistivity remains very high. Passage between the conductive and insulating states is carried out in accordance with a hysteresis curve. For a given light flux, there can be two transmission states of the cell associated with the photoconductor, such that the photoconductive material can be in one or other state (conductive or insulating). Thus, a logic information can be recorded.

Optical computer memories function with such devices, although the latter do not have very high performance characteristics. Thus, the switching time of such a bistable device is long (a few milliseconds), which makes it impossible to carry out high frequency logic operations.

SUMMARY OF THE INVENTION

The aim of the present invention is to supply a bistable electrooptical device with a fast switching time of approximately 1 microsecond.

As switching is approximately one thousand times faster than in liquid crystal cell devices, a much larger number of logic operations can be carried out during the same time.

A device according to the invention has the advantage of a simple construction using well-known production procedures.

The present invention relates to a bistable electrooptical device comprising a first and a second substrate, means for hermetically sealing the first and second substrates to one another, so as to form a vacuum enclosure and contained in the latter at least one bistable element incorporating on the one hand, supporting by the first substrate, a first layer of conductive material, a layer of photoconductive material and a layer of cathodoluminescent material, and on the other hand a means for exciting said cathodoluminescent material.

According to a variant, the first substrate and the first conductive material layer are transparent.

According to a special embodiment, a bistable element incorporates a second conductive material layer, the first and second conductive material layers being separated and deposited on the first substrate, the photoconductive material layer covering at least partly the first and second conductive material layers in such a way as to electrically connect said conductive material layers, the conductive material layers and the photoconductive material layer forming a substantially coplanar structure covered by the cathodoluminescent material layer.

The second conductive material layer can optionally be transparent.

According to a variant of this embodiment, an insulating layer is inserted between the substantially coplanar structure and the cathodoluminescent material layer, said insulating layer being provided with an opening made level with the second conductive material layer in such a way that an electrical contact is produced between the second conductive material layer and the cathodoluminescent material layer. This insulating layer makes it possible to insulate the first conductive material layer and the cathodoluminescent material layer, when the photoconductive material does not entirely cover the first conductive material layer.

According to another embodiment, the first conductive material layer is deposited on the first substrate, the photoconductive material layer at least partly covering the first conductive material layer, said layers forming a stack structure covered by the cathodoluminescent material layer and the bistable element has a means for electrically insulating the first conductive material layer from the cathodoluminescent material layer.

According to a variant of said embodiment, the means for electrically insulating the first conductive material layer from the cathodoluminescent material layer can be constituted by an extension of the photoconductive material layer completely covering the first conductive material layer.

Said means for electrically insulating the first conductive material layer from the cathodoluminescent material layer can be constituted by an insulating layer covering the stack structure, when the photoconductive material layer partly covers the first conductive material layer, said insulating layer being provided with an opening level with the photoconductive material layer, so as to ensure an electrical contact between the photoconductive material layer and the cathodoluminescent material layer.

According to a variant of the second embodiment, the stack structure comprises a second conductive material layer at least partly covering the photoconductive material layer. This second layer can be partly placed on the substrate.

The bistable device has two operating modes describes hereinafter, the one having a zero or constant excitation light flux and the other a constant excitation voltage.

According to an embodiment for an operation with a constant excitation flux or voltage, the device comprises a light source e.g. positioned outside the enclosure.

When the device according to the invention operates at constant voltage with an external light excitation, the external light source is advantageously positioned alongside the first substrate, the latter and the first conductive material layer then having to be transparent. Moreover, when the device according to the invention is used in a display screen, the light emitted by the cathodoluminescent material is advantageously transmitted through layers placed between said material and the first substrate and the assembly must be transparent.

It is possible to use various means for exciting the cathodoluminescent material. Reference is more particularly made to a microtip emissive cathode electron source, a semiconductor diode electron source having a metal-insulator-metal structure or any other electron source.

Advantageously, when the device comprises several bistable elements, a single cathodoluminescent material layer is common to all the bistable elements. When the device comprises several bistable elements, the latter can be arranged in matrix form. This arrangement permits a multiplexed operation of the bistable elements, which can facilitate the control of the device.

In a matrix arrangement, the first conductive material layers are advantageously interconnected in parallel conductive columns and the excitation means is controlled in accordance with parallel rows.

Another object of the invention consists of making use of the bistability of said device and therefore the possibility of storing a state in order to obtain a very bright and advantageously multiplexed flat display screen.

therefore the present invention relates to a flat screen incorporating a bistable device having several bistable elements arranged in rows and columns, each bistable element of a row and a column forming a pixel of the screen.

The control of such a screen is multiplexed. By applying appropriate control voltages taking advantage of the bistability of the elements, once an addressed pixel is placed in the "on" state, said state can be maintained until the following addressing of the pixel in question, i.e. throughout the raster time. Normally, an "on" state is only maintained during the addressing time of a row. Thus, the brightness of the screen is improved by a factor equal to the number of screen rows. Moreover, the number of rows of a screen is not limited. It is possible to produce large screens, whilst still retaining a control simplicity.

The signals corresponding to the informations to be displayed are delivered to conductive columns produced by first conductive material layers connected to one another. These conductive columns are anodes and have much lower capacitances (by a factor of 500 to 1000) than cathodes to which these signals are conventionally applied.

Thus, the capacitive power required for controlling the screen is reduced by the same amount. Thus, the electron sources have limited thicknesses and therefore high capacitances, whereas a bistable element has a lower capacitance.

The present invention also relates to a process for producing such a screen.

The pixels of the screen can assume an "on" or "off" state and the process consists of successively addressing the rows of pixels and during the addressing of a row, bringing all the pixels of said row into an "off" state, followed by the illumination of the pixels of said row and maintaining the pixels of the not addressed rows in the state assumed during the preceding addressing.

According to a special embodiment,

V0 is a lower threshold voltage for the bistability of a bistable element.

V1 is the upper threshold voltage for the bistability of a bistable element, the state of a pixel located at the intersection of a row and a column is controlled by applying a potential difference between said conductive column (anode) and a cathode of said means for exciting the cathodoluminescent material, said cathode exciting the row in question, A—during the addressing of a row:

a) for a time Te, the cathode in question is raised to a potential $-VIN$, then, b) for a time Ta, the cathode in question is raised to a potential $-VIB$, 1) for illuminating the pixel located at the intersection of the row in question and the column in question, i) for the time Te, the column is raised to a potential $-Vc$, with the condition $VIN-Vc<VO$, ii) for the time Ta, the column is raised to a potential Vc, with the condition $VIB+Vc>V1$, 2) for extinguishing the pixel at the intersection of the row in question and the column in question, i) for the time Te, the column is raised to a potential Vc, with the condition $VIN+Vc<VO$, ii) for the time Ta, the column is raised to a potential $-Vc$, with the condition $VIB-Vc<V1$, B—outside the addressing of the row in question, the cathode in question is raised to a potential $-Vr$ such that $Vr+Vc<V1$ and $Vr-Vc>V0$ in order to maintain the pixels of the row in question in the stable assumed during the preceding addressing.

BRIEF DESCRIPTION OF THE DRAWINGS

The invention is described in greter detail hereinafter relative to non-limitative embodiments and the attached drawings, wherein show:

FIG.—Diagrammatically a section view of a device according to the invention.

FIG. 2A—Diagrammatically a partial view of a device according to the invention

FIG. 2B—Diagrammatically a variant of a bistable element.

FIG. 3—A variant of a bistable element.

FIG. 4—Diagrammatically an embodiment of an exciting means for a cathodoluminescent layer.

FIG. 5—Diagrammatically a second embodiment of an exciting means of a cathodoluminescent layer.

FIG. 6—Diagramatically a third embodiment of an exciting means of a cathodoluminescent layer.

FIG. 7—Diagrammatically a hysteresis curve revealing the bistability of a bistable element during constant control voltage excitation.

FIG. 8—Diagrammatically a hysteresis curve revealing the bistability of a bistable element during a constant input light flux excitation.

DETAILED DESCRIPTION OF PREFERRED EMBODIMENT

Figure 9:
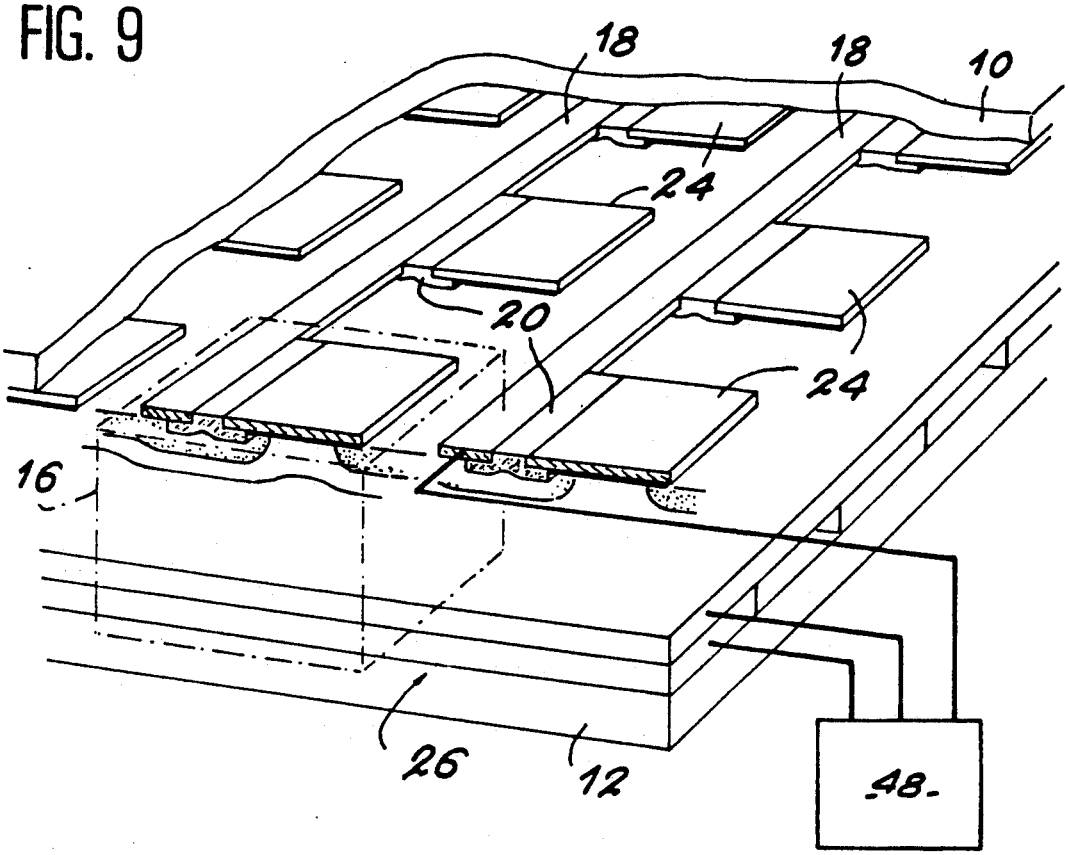
FIG. 9—Diagrammatically a screen according to the invention.

FIG. 1 diagrammatically constitutes a sectional view of a bistable electrooptical device according to the invention. This device comprises an optionally transparent, e.g. glass, first substrate 10 and a second, e.g. glass substrate 12. A joint 14, e.g. of fusible glass, hermetically seals the first and second substrates 10, 12 to one another, so as to obtain an enclosure in which a high vacuum is produced (e.g. $10^{-6}$ mm Hg).

In the embodiment shown, the device comprises, contained in the said enclosure, several bistable elements 16 arranged in matrix manner in rows and columns. Each bistable element 16 comprises, supported by the first substrate, a series of layers forming a stack structure.

A first optionally transparent, conductive material layer 18, e.g. of indium and tin oxide (ITO) is deposited on the substrate 10 and has a thickness of e.g. 500 Å. A photoconductive material layer 20, e.g. formed by a stack of n+ doped amorphous silicon (a-Si-n+), amorphous silicon (a-Si) and n+ doped amorphous silicon (a-Si-n+), covers the entire first conductive material layer 18. The layer 20 e.g. has a thicknes of 1 to 2 μm. A cathodoluminescent material layer 22, e.g. of zinc sulphide (ZnS) covers the photoconductive material layer and has e.g. a thickness of 10 μm. Optionally, a second transparent conductive material layer 24 (e.g. ITO) is deposited so as to form a contact between the photoconductive material layer 20 and the cathodoluminescent material layer 22. This contact defines the active zone of each bistable element. This layer 24 e.g. has a thickness of 500 to 1000 Å. This layer makes it possible to ensure a good ohmic contact between the photoconductive material and the cathodoluminescent material 22.

FIG. 2A shows that a single cathodoluminescent material layer 22 is common to all the bistable elements, which simplifies the deposition of said layer.

FIG. 2A also shows that the first conductive material layers 18 are interconnected to form conductive columns. Thus, it is possible to carry out a multiplexed control of the bistable elements 16, if the excitation means is row-controllable. The layer 24 is etched in such a way that the contacts between the layers 20 and 22 formed in this way define separate bistable elements.

FIG. 2B diagrammatically shows a variant of a bistable element in a stack arrangement. This sectional view shows that an insulating layer 23 covers the photoconductive material layer 20. This insulating layer 23 has an opening 25 freeing the base of the photoconductive material layer 20, so as to ensure an electrical contact between the layer 20 and the photoluminescent material layer 22.

FIG. 3 diagrammatically shows a variant of a bistable element. The layers are arranged in accordance with a substantially coplanar structure. The first conductive material layer 18 and the second conductive material layer 24 are placed on the first substrate 10. The photoconductive material layer 20 completely covers the conductive material 18 and partly covers the layer 24. The cathodoluminescent material layer 22 covers the coplanar structure 18, 20, 24, whilst having no contact with the layer 18 and a contact with the layer 24.

FIG. 1 shows a bistable element 16 with a means 26 for exciting the cathodoluminescent material layer 22. This means 26 is an electron source supported by the second substrate 12.

In the embodiment shown in FIG. 1, where the bistable elements 16 are arranged in matrix form, the means 26 permits an excitation of successive rows of bistable elements.

FIG. 4 diagrammatically shows a first embodiment of a means 26 for exciting the cathodoluminescent material layer. It is a microtip emissive cathode electron source. For example, such a source is described in French patent application 2 623 013.

In the embodiment shown in FIG. 4, conductive rows 28 are deposited on the substrate 12. These rows support microtips 30 able to emit electrons. They are covered by an insulating layer 32 having openings or orifices 34 at the locations of the microtip 30.

A single grid 36, which has orifices 38 facing the orifices 34 of the insulating layer 32, is deposited on the latter.

According to a not shown embodiment of such an electron source, rows are formed on the grid, whereas the microtips rest on a common conductive layer.

FIG. 5 diagrammatically shows a second embodiment of a means for exciting the photoconductive material layer. It is a diode electron source having a metal-insulator-metal (MIM) structure (or MDM structure for metal-dielectric-metal). Such an electron source is described in the book by Fridrikhov and Movnine, entitled "Physical Bases of Electronics" published by Mir.

In the embodiment shown in FIG. 5, metal conductive rows 38 rest on the substrate 12. Each conductive row 38 is covered by a thin dielectric layer 40. The dielectric (insulating) layers 40 are covered by a single metallic film 42. At the locations of the conductive rows 38, the MIM structure forms a diode able to emit electrons.

FIG. 6 diagrammatically shows a third embodiment of a means for exciting the cathodoluminescent material layer. It is a semiconductor diode electron source. A description of such an electron source is given in the above book.

The semiconductor-metal structure sources and the p-n junction sources belong to the category of semiconductor diode sources.

FIG. 6 shows in an exemplified, non-limitative manner an electron source having a semiconductor-metal structure. Semiconductor material rows 44 rest on the substrate 12 and are covered by a metallic layer 46.

No matter which electron source is used, it appropriately only functions when correctly polarized with respect to the potential applied to the first conductive material layer 18 (FIG. 1)

Adequate control voltages are applied across a control means 48 shown in FIG. 1. This control means 48 is connected to the electrodes (18, 28, 36 or 18, 38, 42 or 18, 44, 46), by contacts passing out of the enclosure. The conductive material layers 18 serve as an anode. The rows in the electron sources are cathodes.

A description will now be given of a first operational embodiment of a bistable element with respect to FIG. 7 showing an output light flux Fs emitted by the cathodoluminescent material or, which amounts to the same thing, an acceleration voltage Va of the electrons emitted by the electron source, as a function of the voltage Vak applied between the anode and the cathode at the intersection of which is located the bistable element in question.

The current emitted by the electron source 26 (FIG. 1) is kept fixed by applying an adequate control voltage. This voltage is applied between the grid 36 and the cathode 28 in question for a microtip emissive cathode electron source (FIG. 4) between the metallic film 42 and the metallic layer 38 constituting the cathode in question a MIM structure (FIG. 5), or between the metallic layer 46 and the semiconductor layer 44 constituting the cathode in question for a semiconductor structure (FIG. 6).

The electrons emitted by the electron source are more or less accelerated as a function of the value of the potential difference Vak applied between the anode and cathode in question.

FIG. 7 (part A of the curve) shows that by increasing Vak, the acceleration voltage Va of the electrons, after remaining substantially equal to a minimum value, suddenly passes to a maximum value when Vak exceeds a threshold V1 approximately equal to 100 V. On reducing Vak from a value higher than V1 (part B of the curve), the voltage Va substantially maintains its maximum value and then suddenly drops to its minimum value when Vak drops below a threshold Vo approximately equal to 90 V.

The curve describing the output light flux Fs is identical to that describing the behaviour of Va. Thus, when the acceleration voltage is low, the cathodoluminescent material emits little light and the conductivity of the photoconductive material is low. The more the potential difference Vak is increased, the more the electrons are accelerated and produce cathodoluminescence. On clearing the threshold V1, the resistance of the photoconductive material becomes minimal and the acceleration voltage and therefore the output light flux become maximal.

The phenomenon is similar, but in the reverse direction, when Vak decreases. The curve describes a hysteresis cycle having an operating zone between V0 and V1 with two stable states. For this first operating mode, the input light flux, the external light flux directed towards the photoconductive material, is considered to be constant or zero.

With reference to FIG. 8, a description will now be given of a second operating embodiment, in which the potential difference Vak is kept constant and the output light flux variation is dependent on the variation of an input light flux.

As can be seen in FIG. 1, said input light flux is supplied by a light source 50 located outside the enclosure containing the bistable elements. This light source is controlled by the control means 48. The different bistable elements can be illuminated independently of one another advantageously from the substrate 10. Such a light source 50 can e.g. be formed by one or more lasers, or by one or more other bistable elements.

On returning to FIG. 8, it can be seen that the conductivity of the photoconductive material is varied by subjecting it to an increasingly intense input light flux Fe. Below a threshold F1 (part C of the curve), the conductivity is minimal and consequently as previously, the voltage Vak being substantially entirely brought to the boundaries of the photoconductive material for a low acceleration voltage. Therefore the output light flux Fs is minimal. Above the threshold F1, the conductivity is maximal. The voltage at the boundaries of the photoconductive material is negligible and the acceleration voltage becomes maximal and consequently so does the output light flux Fs.

By reducing the input light flux (part D of the curve), the reverse phenomenon is obtained and a switching from the maximum to the minimum value of Fs when Fe drops below a threshold value Fo.

Therefore the curve describes a hysteresis cycle having an operating zone between Fo and F1 with two stable states.

In either of these operating modes, the switching from one stable state to the other is obtained in approximately 1 microsecond. Thus, fast optoelectronic memories can be produced, which are able to compete with electronic systems and which are simple to construct. Apart from optoelectronic memories, a device according to the invention makes it possible to produce a flat display screen.

Such a screen is diagrammatically shown in FIG. 9. It has the previously described elements of the bistable electrooptical device and the references are the same as in FIG. 1. Throughout the remainder of the description, consideration will be given to this screen from the side of the substrate 10.

The screen is in matrix form, the bistable elements 16 being arranged in rows and columns, each bistable element corresponding to a pixel of the screen. The first conductive material layers 18 are interconnected to form conductive columns and the electron sources are controlled in row form, a bistable element being defined at the intersection of the rows and columns.

As can be seen in FIGS. 2A, 2B, 3, 10 and 11, several arrangements of layers supported by the transparent substrate 10 are possible.

Figure 10:
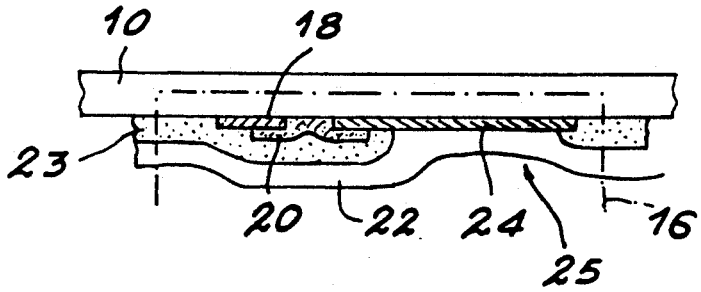
FIGS. 10 and 11—In each case a partial, diagrammatic view view of a section of a bistable element for producing said screen.

A coplanar structure different from that of FIG. 3 is shown diagrammatically and sectionally in FIG. 10.

The first and second conductive material layers 18, 24 are deposited on the first substrate 10. As has been seen, the first layer 18 is in the form of a conductive column, the second 24 defines the dimensions of the pixel and is also transparent.

In the embodiment shown in FIG. 10, the first and second conductive material layers 18, 24 are interconnected by a photoconductive material layer 20, which partly covers them. An insulating material layer 23 covers this coplanar arrangement, with the exception of a location corresponding to an opening 25 and which is level with the second conductive layer 24. This coplanar arrangement is covered by a cathodoluminescent material deposit 22, which has an electrical contact with the single second layer 24.

Figure 11:
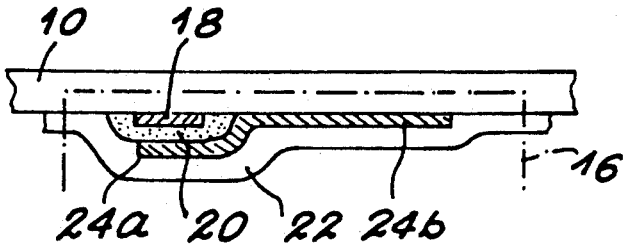

FIG. 11 diagrammatically shows a section of another stack structure differing from that of FIGS. 1, 2A and 2B. The first conductive material layer 18 deposited on the substrate 10 is covered by a photoconductive material layer 20. A second conductive material layer 24 has a portion 24A, which at least partly covers the photoconductive material layer 20 and another portion resting on the substrate 10, whose geometry defines the dimensions of the pixel. The structure is covered by a cathodoluminescent material layer 22.

As has been seen hereinbefore, the electron source 26 (FIG. 9) is able to excite successive rows of pixels in the screen under the action of the control means 48. For each addressing of a row of the screen, the control means 48 supplies control signals on the conductive columns in order to illuminate or extinguish the pixels of said row.

FIGS. 12A to 12E diagrammatically show timing diagrams for the control of the state of a pixel of the screen. In these diagrams, the amplitude scales of the potentials are not respected.

The screen is controlled with an input light flux and an electron current of a constant nature. The conductivity of the photoconductive material of the pixel in question is varied by varying the potential difference applied between the anode and the cathode (namely the conductive column associated with the pixel and e.g. the conductive row of a microtip emissive cathode electron source, the pixel in question being located at the intersection of the said row and the said column).

When the conductivity of the photoconductive material is minimal, the acceleration voltage of the electrons is minimal and the pixel is in the extinguished or off state. When the conductivity of the photoconductive material is maximal, the acceleration voltage of the electrons is maximal and the pixel is in the illuminated or on state.

Figure 12A:
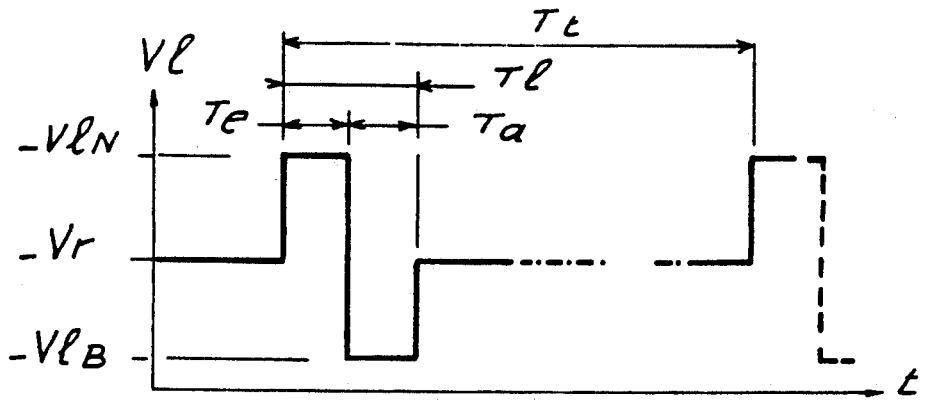
FIGS. 12A to 12E—Diagrammatically timing diagrams for controlling an on and off state of a pixel of the screen.

According to the process of the invention, successive addressing takes place of the rows of pixels. FIG. 12A shows the potential VI applied to a cathode (row) as a function of time. A given row is addressed for all the raster times Tt. The addressing time of a row TI is divided into two periods, namely a first period Te devoted to the erasing of the state of the pixels of the addressed row (all the pixels being brought into an off state) and a second addressing period Ta during which the pixels are brought into the state which they must assume.

For the time Te, VI assumes a value −VIN, with VIN e.g. equal to 80 V. During Ta, VI assumes a value −VIB with VIB e.g. being equal to 100 V. VI assumes the value −Vr for the remainder of the time with Vr being e.g. equal to 95 V.

Figure 12B:
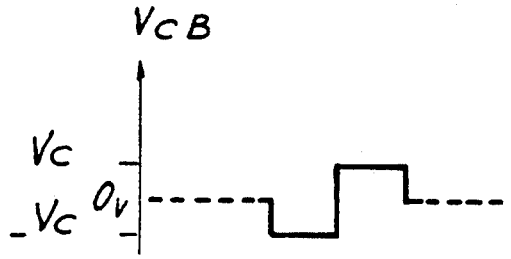

FIG. 12B diagrammatically shows the potential VcB applied to a conductive column for obtaining a pixel in the illuminated state. During the erasing period Te, the potential VcB assumes the values −Vc. The values Vc and VIN are chosen such that VIN±Vc is below VI, which is the lower threshold value of the bistable element (FIG. 7). As has been shown hereinbefore, Vo can be equal to 90 V. VIN is chosen equal to 80 V, Vc being e.g. equal to 4 V. During the period Ta, VcB assumes the value Vc.

Figure 12C:
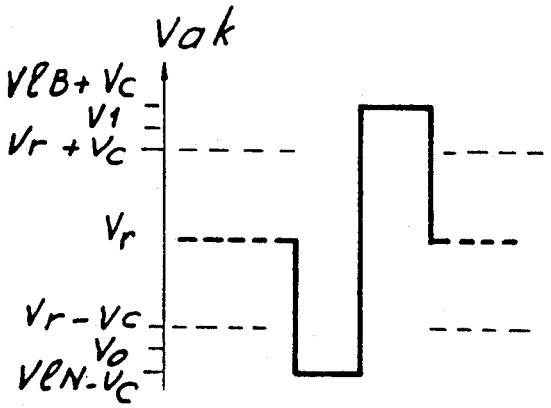

FIG. 12C diagrammatically shows the potential difference Vak between the anode and the cathode for bringing a pixel into an illuminated state. During the erasing period Te, Vak assumes the value VIN−Vc, i.e. in the embodiment described 76 V, which is well below Vo. The photoconductive material has a minimum conductivity leading to a minimum acceleration voltage of the excitation electrons. The output light flux is negligible. No matter what its preceding state (represented by the dots in FIG. 12C), the pixel is brought into an extinguished state.

During the addressing period Ta, Vak assumes the value VIB+Vc, i.e. in the embodiment described 104 V, which is well above the threshold value V1 (FIG. 7). The conductivity of the photoconductive material becomes maximal leading to a maximum output light flux and the pixel is well illuminated.

Figure 12D:
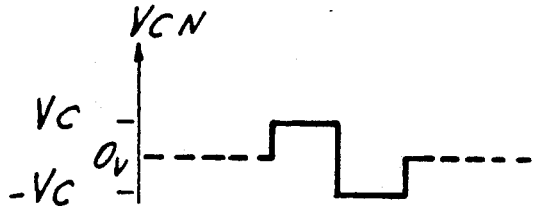

FIG. 12D diagrammatically shows the potential VcN applied to a conductive column for obtaining a pixel in an extinguished state. During the erasing period Te, the potential VcN assumes the value Vc and then the value −Vc during the addressing period.

Figure 12E:
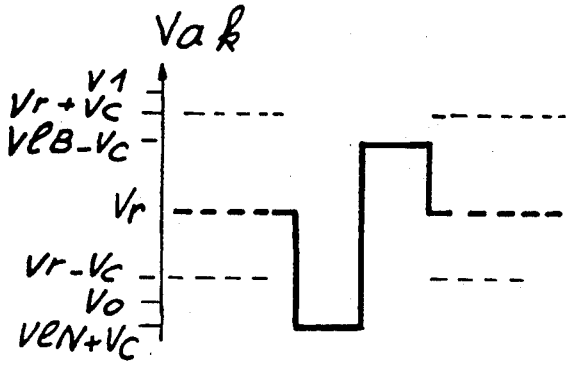

FIG. 12E diagrammatically shows the potential difference Vak between the anode and the cathode for bringing a pixel into an extinguished state, no matter what its preceding state, represented by dots in FIG. 12E.

During the erasing period, Vak assumes the value VIN+Vc, i.e. in the described embodiment 84 V, which is well below Vo, the pixel being brought into an extinguished state. During the addressing period Ta, Vak assumes the value VIB−Vc, i.e. in the embodiment described 96 V, which is well below V1 and the pixel remains in the preceding, i.e. extinguished state.

During two addressing periods of a row, the states assumed by the pixels thereof are stored by bistable elements corresponding to each pixel. The columns are permanently brought to a potential ±Vc for controlling pixels of the other rows. Between two addressing operations, each row is brought to a potential value −Vr. The values Vr and Vc are such that the potential Vak=Vr±Vc between two addressing operations is between Vo and V1. It has been seen hereinbefore that Vr is e.g. chosen equal to 95 V and Vc to 4 V. Therefore Vr±Vc is contained in the range 90 to 100 V, i.e. in the bistability zone making it possible to maintain the pixels of the row in question in the state assumed during the preceding addressing operation. The storage of the state of the pixels explains the need for an erasing period before each new addressing operation.

If N is the number of rows of a screen, as a result of said storage, an illuminated state of a pixel is maintained N times longer than in a conventional screen, where the illuminated state is only maintained in the addressing period of the corresponding row. Thus, a much brighter screen than in the prior art is obtained. Moreover, for such a screen, the number of rows is no longer a constraint. The production of large screens with a large number of rows for a high definition display is possible.

The invention is not limited to the embodiments described and represented herein and in fact variants thereto are possible. In particular, other types of electron sources can be used or, for a screen, other production processes are possible.

I claim:

1. A bistable electrooptical device, and comprising:

a. first and second substrates;

b. means for hermetically sealing first and second substrates to one another, so as to provide a vacuum enclosure therebetween;

c. at least one bistable element contained within said vacuum enclosure, said at least one element incorporating a first layer of conductive material, a layer of photoconductive material, and a layer of cathodoluminescent material, said layers of conductive, photoconductive, and cathodoluminescent materials being disposed upon said first substrate, said element also incorporating means for exciting said cathodoluminescent material and a second conductive material layer, said first and second conductive material layers being separated from each other and directly deposited upon said first substrate, said layer of photoconductive material at least covering said first conductive material layer and partially covering said second conductive material layer so as to electrically connect said conductive material layers, said conductive material layers and said photoconductive material layer forming a structure totally covered by said cathodoluminescent material layer.

2. A bistable electrooptical device according to claim 1, wherein the first substrate and the first conductive material layer are transparent.

3. A bistable electrooptical device according to claim 1, wherein the second conductive material layer is transparent.

4. A bistable electrooptical device according to claim 1, wherein an insulating layer is placed between the substantially coplanar structure and the cathodoluminescent material layer, said insulating layer being provided with an opening made level with the second conductive material layer in such a way that an electrical contact is produced between the second conductive material layer and the cathodoluminescent material layer.

5. A bistable electrooptical device according to claim 1, and further comprising a light source.

6. A bistable electrooptical device according to claim 1, wherein the means for exciting the cathodoluminescent material incorporates a microtip emissive cathode electron source.

7. A bistable electrooptical device according to claim 1, wherein the means able to excite the cathodoluminescent material incorporates a diode electron source having a metal-insulator-metal structure.

8. A bistable electrooptical device according to claim 1, wherein the means able to excite the cathodoluminescent material has a semiconductor diode electron source.

9. A bistable electrooptical device according to claim 1, wherein the device incorporates several bistable elements and a single cathodoluminescent material layer is common to all the bistable elements.

10. A bistable electrooptical device according to claim 1, wherein the device incorporates several bistable elements, the latter being arranged in rows and columns in matrix form.

11. A bistable electrooptical device according to claim 10, wherein the first conductive material layers are interconnected so as to form parallel conductive columns, the means for exciting said cathodoluminescent material being able to excite parallel rows.

12. A flat display screen, comprising a device according to claim 10, each bistable element corresponding to a pixel of the screen.

13. A process for producing a screen according to claim 17, wherein the pixels of the screen can assume an "on" state or an "off" state, the process comprising successively addressing the rows of pixels, during the addressing of a row, raising all the pixels of said row to an "off" state, followed by the illumination of the pixels of the row which have to be illuminated and maintaining the pixels of the rows which are not addressed in the state assumed during their preceding addressing.

14. A process according to claim 13, wherein V0 is a lower threshold voltage for the bistability of a bistable element,

V1 is the upper threshold voltage for the bistability of a bistable element, the state of a pixel located at the intersection of a row and a column is controlled by applying a potential difference between said conductive column (anode) and a cathode of said means for exciting the cathodoluminescent material, said cathode exciting said row, said process comprising:

A—during the addressing of said row:

a) for a time Te, raising said cathode to a potential $-VIN$, then, b) for a time Ta, raising said cathode to a potential $-VIB$, by 1) illuminating the pixel located at the intersection of the row and the column, by i) for the time Te, raising the column to a potential $-Vc$, with the condition $VIN-Vc<V0$, and ii) for the time Ta, raising the column to a potential Vc, with the condition $VIB+Vc>V1$, and 2) extinguishing the pixel at the intersection of the row and the column, by i) for the time Te, raising the column to a potential Vc, with the condition $VIN+Vc<V0$, and ii) for the time Ta, raising the column to a potential $-Vc$, with the condition $VIB-Vc<V1$, B—outside the addressing of the row, raising the cathode to a potential $-Vr$ such that $Vr+Vc<V1$ and $Vr-Vc>V0$ in order to maintain the pixels of the row in the state assumed during the preceding addressing.

* * * * *